US006204869B1

(12) United States Patent
Raker et al.

(10) Patent No.: US 6,204,869 B1
(45) **Date of Patent: *Mar. 20, 2001**

(54) CONTROL SYSTEM FOR TEST PATCH AREA EXPOSURE IN A PRINTING MACHINE

(75) Inventors: Cathleen J. Raker; Sue K. Lam-Chon; Patrick O. Waller, all of Rochester; Daniel R. Maurer, Fairport; Joseph W. Ward, Pittsford; Rosario A. Bracco, Webster; Ronald E. Shaul, Bloomfield; Robert M. Mara, Fairport; Raymond L. Mongeon, Rochester; Joseph A. Mastrandrea, Webster; Patricia A. Papaleo, Rochester; Colleen Tremaine, Pittsford, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/216,901

(22) Filed: Dec. 21, 1998

Related U.S. Application Data

(60) Provisional application No. 60/084,051, filed on May 4, 1998.

(51) Int. Cl.[7] ..... G03G 15/00

(52) U.S. Cl. ..... 347/129; 399/72

(58) Field of Search ..... 399/72; 347/115, 347/116, 129, 131, 234, 235, 248, 250

(56) References Cited

U.S. PATENT DOCUMENTS

| | | | | |
|---|---|---|---|---|
| 4,341,461 | | 7/1982 | Fantozzi | 355/14 D |
| 4,949,105 | | 8/1990 | Prowak | 346/154 |
| 5,103,260 | * | 4/1992 | Tompkins et al. | 347/250 |
| 5,170,340 | | 12/1992 | Prokop et al. | 364/143 |
| 5,175,590 | | 12/1992 | Frankel et al. | 355/296 |
| 5,264,872 | * | 11/1993 | Wong | 399/72 X |
| 5,543,896 | | 8/1996 | Mestha | 355/208 |
| 5,652,946 | | 7/1997 | Scheuer et al. | 399/49 |
| 5,826,139 | * | 10/1998 | Nacman et al. | 399/72 |

* cited by examiner

*Primary Examiner*—Joan Pendegrass
(74) *Attorney, Agent, or Firm*—Oliff & Berridge, PLC

(57) ABSTRACT

There is provided a method for use with a printing machine having a movable imaging member and a projecting system for modulating a beam and projecting an image into the movable imaging member. The printing machine further includes a developer for application of developer material to the image projected onto the movable imaging member for transfer of the image to a print media sheet. The method, which is intended for use in controlling exposure of a test patch on the movable imaging member includes the steps of: a) providing a time-keeping device with the time-keeping device including a variable value which is either incrementable or decrementable; b) detecting a signal indicating that the movable imaging member is positioned relative to the beam in a selected orientation, wherein the movable imaging member passes by the beam at a selected speed; c) providing a reference value with the reference value varying as a function of the selected speed; d) in response to the detecting of (b), modulating the beam, relative to the movable imaging member, so as to expose a portion for the test patch; e) concurrent with the modulating of (d), incrementing or decrementing the variable value of the time keeping device; and f) repeating said modulating of (d) until the value of the variable value is about equal to the reference value and the test patch is exposed.

14 Claims, 7 Drawing Sheets

CONTROL SYSTEM FOR TEST PATCH AREA EXPOSURE IN A PRINTING MACHINE

This nonprovisional application claims the benefit of U.S. Provisional Application No. 60/084,051 filed May 4, 1998.

BACKGROUND

This invention relates generally to xerographic process control, and more particularly, to a programmable technique in which a prestored value or count is used to control the extent to which an imaging member is exposed by a beam for the purpose of generating a developer material patch.

In copying or printing systems, such as a xerographic copier, laser printer, or ink-jet printer, a common technique for monitoring the quality of prints is to artificially create a "test patch" of a predetermined desired density. The actual density of the printing material (toner or ink) in the test patch can then be optically measured to determine the effectiveness of the printing process in placing this printing material on the print sheet.

In the case of xerographic devices, such as a laser printer, the surface that is typically of most interest in determining the density of printing material thereon is the charge-retentive surface or photoreceptor, on which the electrostatic latent image is formed and subsequently, developed by causing toner particles to adhere to areas thereof that are charged in a particular way. In such a case, the optical device for determining the density of toner on the test patch, which is often referred to as a "densitometer", is disposed along the path of the photoreceptor, directly downstream of the development of the development unit. There is typically a routine within the operating system of the printer to periodically create test patches of a desired density at pre-established locations on the photoreceptor by deliberately causing the exposure system thereof to charge or discharge as necessary the surface at the location to a predetermined extent.

It is also understood that the amount of charge applied to the photoreceptor can be controlled through monitoring of a voltage in the exposed test patch area. Commonly, this is accomplished through employment of an electrostatic voltmeter ("ESV") disposed adjacent the photoreceptor, upstream of the development unit.

The latent test patch pattern is then moved past the developer unit and the toner particles within the developer unit are selectively electrostatically attracted to the test patch pattern. The quantity or density of the toner on the test patch causes proportional darkness or saturation of the test patch in optical measurement. The developed test patch is thus moved past a densitometer disposed along the path of the photoreceptor, and the light absorption of the test patch is tested. The proportion of light that is absorbed by the test patch correlates closely to the quantity of toner on the test patch. As a result, the printing system can use the densitometer signal to ascertain the correct level of development or proper amount of toner or ink deposition.

In any printing system using test patches for monitoring print quality, a design problem inevitably arises of where to place these test patches, particularly on photoreceptor belts or drums. Xerographic test patches are traditionally printed in the interdocument zones between printed images of a photoreceptor having multiple "pitches". These patches are used to control the deposition of toner on images printed on paper in order to monitor and regulate the tone reproduction curve (TRC) of the printer. Generally each patch area may be about an inch square, and is selectively printed as a uniform area that is one of: solid half tone, solid (saturated), or halftone (patterned gray or background (white)).

This practice enables the sensor to read one point value on the tone reproduction curve for each test patch corresponding to its density. However, that is insufficient to complete the measurement of the entire curve at reasonable intervals, especially in a multi-color print engine. To have an adequate number of points on the curve, multiple test patches have to be created. Thus, the traditional method of process controls involves scheduling solid area, uniform halftones or background in a test patch. Some of the high quality printers contain many test patches. During the print run, each test patch is scheduled to have single halftone that would represent a single point byte (8-bit binary) value on the tone reproduction curve (TRC). Full scale TRC's are commonly defined in 8-bit weighted binary values, representing 256 levels of saturation from "white" to "solid saturated".

Various prior art techniques have been proposed to improve the use of test patches for xerographic control. For example, U.S. Pat. No. 5,543,896 to Mestha discloses a method of development control by storing a reference tone reproduction curve and providing a single test pattern including a scale of pixel values in the interdocument zone of the imagining surface. The system senses the test pattern along the scale of pixel values in the interdocument zone and responds to the sensing of the test pattern and the reference tone reproduction curve to adjust the machine operation for print quality correction. It is also known in the prior art to image multiple test targets in the interdocument zones of the photoreceptor (see e.g. U.S. Pat. No. 4,341,461 to). For example, two test targets each having two test patches are selectively exposed singly or in overlapping relationship to provide test data to control toner dispensing and developer bias.

Despite process control advancements of the type discussed above, there are still difficulties associated with placing test patches accurately on photoreceptive surfaces. One solution for placing a test patch across a photoreceptor, i.e. placing the test patch in a direction perpendicular to the process direction of the photoreceptor otherwise described as the "fast scan" direction of the photoreceptor, is disclosed by U.S. Pat. No. 4,949,105 to Prowak. In the '105 Patent a pixel counter is used in conjunction with two comparators for delineating the extent to which a test patch is written on the photoreceptor in the fast scan direction. More particularly, patch writing control is achieved with the logical circuit of FIG. 5 in such a manner that the patch is written, in accordance with data stored in one of registers 84 and 86, provided the Patch Print Enable signal is enabled and the patch address (in the fast scan direction) is between the Patch Start Address and Patch Stop Address. Control of patch writing in the process direction of the photoreceptor, i.e. the "slow scan" direction of the photoreceptor, is achieved through suitable timing. U.S. Pat. No. 4,949,105 does not suggest that the control of writing in the slow scan direction is critical and it is believed the '105 Patent test patch could be significantly longer in the slow scan direction than disclosed without affecting the concept upon which the invention of the '105 Patent is based.

In certain conventional printers, particularly high speed printing machines in which test patches are written in the interdocument zone (see e.g. U.S. Pat. No. 5,652,946 to Scheuer et al.), control of patch writing in the slow scan direction is of significant concern. It is known that one conventional copier writes a test patch in the slow scan direction of the interdocument zone by "syncing" a writing signal off of a signal from a marking imaging subsystem. That is, the subsystem provides a signal that controls how long patch exposure or discharge should be enabled in the interdocument zone. Essentially, the writing signal is customized for the host machine and when the speed of the photoreceptor of the host machine is increased, redesign of the mark imaging subsystem is typically required. This sort of redesign can be relatively expensive and time consuming.

Accordingly, it would be desirable to provide a relatively inexpensive, flexible patch writing system that need not be redesigned upon altering the speed of the photoreceptor with which the patch writing system is associated.

SUMMARY OF THE INVENTION

In accordance with one aspect of the presently disclosed invention there is provided a method for use with a printing machine having a movable imaging member and a projecting system for modulating a beam and projecting an image into the movable imaging member. The printing machine further includes a developer for application of developer material to the image projected onto the movable imaging member for transfer of the image to a print media sheet. The method, which is intended for use in controlling exposure of a test patch on the movable imaging member includes the steps of: a) providing a time-keeping device with the time-keeping device including a variable value which is either incrementable or decrementable; b) detecting a signal indicating that the movable imaging member is positioned relative to the writing exposure beam in a selected orientation, wherein the movable imaging member passes by the beam at a selected speed; c) providing a reference value with the reference value; d) in response to said detecting of (b), modulating the beam, relative to the movable imaging member, so as to expose a portion for the test patch; e) concurrent with said modulating of (d), incrementing or decrementing the variable value of the time keeping device; and f) repeating said modulating of (d) until the value of the variable value is about equal to the reference value and the test patch is exposed. In accordance with another aspect of the presently disclosed invention there is provided another method for use with a printing machine having a movable imaging member and a projecting system for modulating a beam and projecting an image into the movable imaging member. The printing machine further includes a developer for application of developer material to the image projected onto the movable imaging member for transfer of the image to a print media sheet. The other method, which is also intended for use in controlling exposure of a test patch on the movable imaging member includes the steps of: a) providing a first time-keeping device and a second time-keeping device with each time-keeping device including a variable value which is either incrementable or decrementable; b) detecting a signal indicating that the movable imaging member is positioned relative to the beam in a selected orientation; c) in response to detecting the signal, using the first time-keeping device to wait a selected interval; d) providing a reference value; e) after waiting the selected interval of said (c), modulating the beam, relative to the movable imaging member, so as to expose a portion for the test patch; f) concurrent with said modulating of (e), incrementing or decrementing the variable value of the second time-keeping device; and g) repeating said modulating of (e) until the value of the variable value of the second time-keeping device is about equal to the reference value and the test patch is exposed.

DESCRIPTION OF THE INVENTION

While the present invention will hereinafter be described in connection with a preferred embodiment thereof, it will be understood that said description is not intended to limit the invention to that embodiment. On the contrary, this invention is intended to cover all alternatives, modifications and equivalents as may be included within the spirit and scope of the invention as defined by the appended claims.

Figure 1:
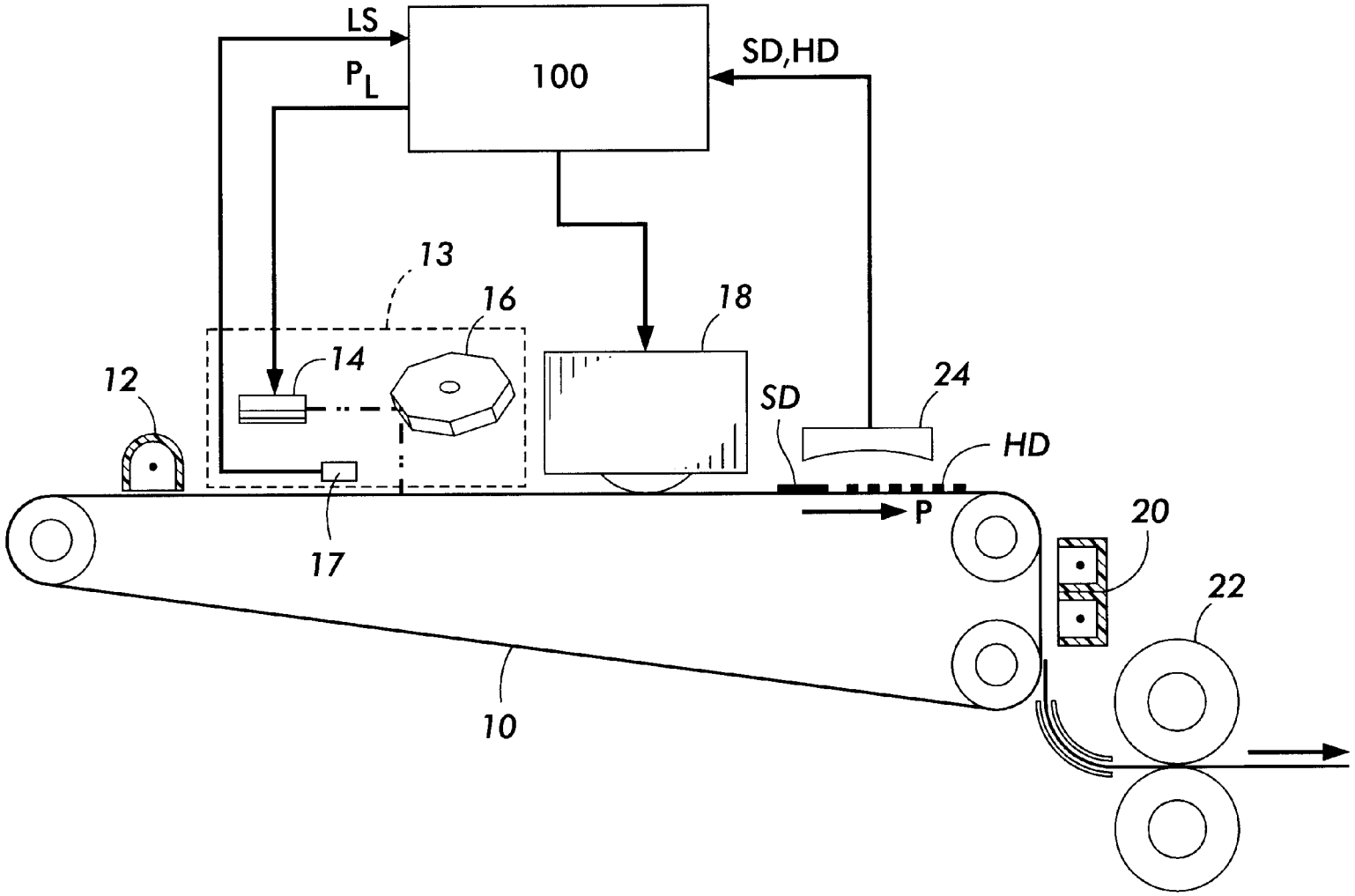
FIG. 1 is an elevational view illustrating a typical electronic imaging system environment suitable for use with a test patch generation control system embodying the present invention.

FIG. 1 shows the basic elements of the well-known system by which an electrophotographic printer or laser printer uses digital image data to create a dry-toner image on plain paper. There is provided in the printer a photoreceptor 10, which may be in the form of a belt or drum, and which comprises a charge-retentive surface. The photoreceptor 10 is here entrained on a set of rollers and caused to move (by means such as a motor, not shown) through process direction P. Moving from left to right in FIG. 1, there is illustrated the basic series of steps by which an electrostatic latent image according to a desired image to be printed is created on the photoreceptor 10, subsequently developed with dry toner, and transferred to a sheet of plain paper.

The first step in the electrophotographic process is the general charging of the relevant photoreceptor surface. As seen at the far left of FIG. 1, this initial charging is performed by a charge source known as a "scorotron", indicated as 12. The scorotron 12 typically includes an ion-generating structure, such as an electrically biased "hot wire", to impart an electrostatic charge on the surface of the photoreceptor 10 moving past it. The charged portions of the photoreceptor 10 are then selectively discharged in a configuration corresponding to the desired image to be printed, by a raster output scanner or ROS 13, which generally comprises laser source 14 and a rotatable mirror 16 which act together, in a manner known in the art, to discharge certain areas of the charged photoreceptor 10.

Also within the ROS, there is provided one or more "scan sensors" 17 which (singley or together, and in conjunction with simple logic devices) compose an LS (line synchronization) signal to suitably control system 100 as described below. Although a laser source is shown to selectively discharge the charge-retentive surface, other apparatus that can be used for this purpose include an LED bar, light emitting diode, or, conceivably, a light-lens system. The laser source 14 is modulated (turned on and off) in accordance with digital image data fed into it, and the rotating mirror 16 causes the modulated beam from laser source 14 to move in a fast-scan direction perpendicular to the process direction P of the photoreceptor 10. The laser source 14 outputs a laser beam of laser power PL which charges or discharges the exposed surface on photoreceptor 10, in accordance with the specific machine design.

After certain areas of the photoreceptor 10 are (in this specific instance) discharged by the laser source 14, remaining charged areas are developed by a developer unit such as 18 causing a supply of dry toner to contact the surface of photoreceptor 10. The developed image is then advanced, by the motion of photoreceptor 10, to a transfer station including a transfer scorotron such as 20, which causes the toner adhering to the photoreceptor 10 to be electrically transferred to a print sheet, which is typically a sheet of plain paper, to form the image thereon. The sheet of plain paper, with the toner image thereon is then passed through a fuser 22, which causes the toner to melt and bond, or fuse, into the sheet of paper to create the permanent print image.

As shown, a densitometer generally indicated as 24 is used after the developing step to measure the optical density of a solid density test patch (marked SD) or a halftone density test patch (HD) created on the photoreceptor 10 using the laser source 14 in conjunction with a patch generator, the details of which patch generator are described further below. The word "densitometer" is intended to apply to any device for determining the density of print material on a surface, such as a visible-light densitometer, an infrared densitometer, an electrostatic voltmeter ("ESV"), or any other such device which makes a physical measurement from which the density of print material may be determined in a suitable control system such as illustrated at 100.

Figure 2:
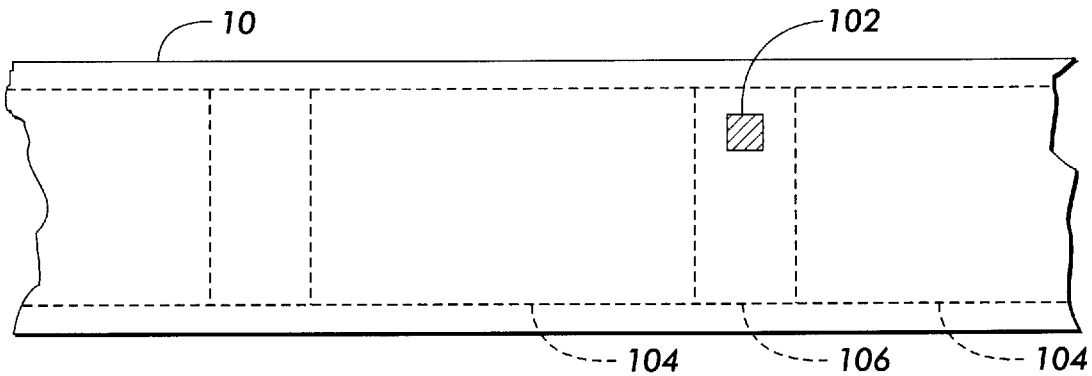
FIG. 2 is an elevational view of a partial section of a photoreceptor used in the typical electronic imaging system environment of FIG. 1.

Referring to FIG. 2, it is contemplated that a test patch 102 will be written between two document zones 104 in a region referred to as the "interdocument zone" with the zone being designated with the numeral 106. It is important that the test patch be written in an accurate manner so that it can be processed easily by the control system 100 and does not interfere with the respective images of the document zones. It is contemplated that such writing can be accomplished, in part, through suitable control of writing in the slow scan direction of the photoreceptor or movable imaging member 10.

Figure 3:
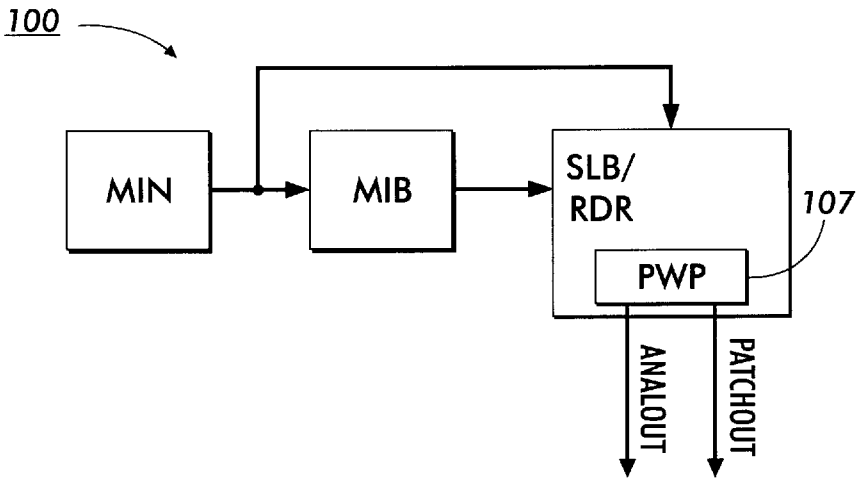
FIG. 3 is a block diagram of various subsystems used for implementing in image output control for the electronic imaging system of FIG. 1.

This suitable control can be achieved by provision of appropriate subsystems used in conjunction with the control system 100. For ease of discussion, it will be assumed that the system 100 includes an image output control ("IOC") of the type shown in FIG. 2 of U.S. Pat. No. 5,170,340 to Prokop et al. (the disclosure of which is incorporated herein by reference) The IOC includes, among other subsystems, marker imaging node ("MIN") software (FIG. 3), a marker imaging buffer ("MIB") and a scan line buffer/ROS diagnostic remote ("SLB/RDR") board. The relationship between the MIN, MIB and SLB/RDR components is shown in FIG. 3. As further shown in FIG. 3, the SLB/RDR board includes a precision width patch ("PWP") generator 107. As is conventional, the SLB/RDR buffers video data for consumption by the ROS. It should be noted that patch control signals ANALOUT AND PATCHOUT are communicated to the ROS from the SLB/RDR, and more particularly from the PWP for controlling the width of the test patch in the process or slow scan direction. The manner in which signals are developed for controlling test patch exposure in the photoreceptor fast scan direction is not the subject of the preferred embodiment and the manner in which test patch exposure control signals are developed for use in the slow scan direction will appear from the description below.

Figure 4:
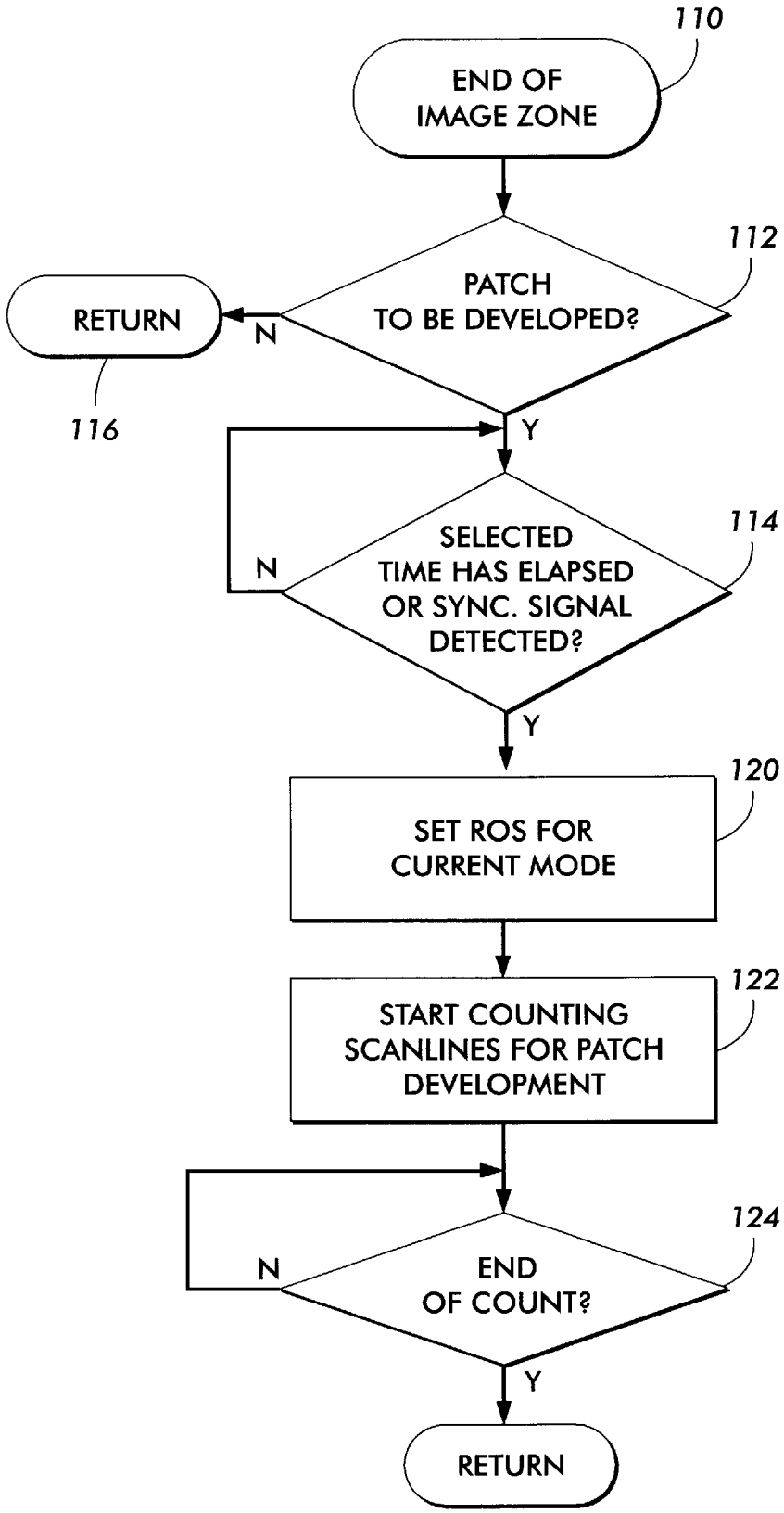
FIG. 4 is a flow chart illustrating a technique for controlling a duration in which the photoreceptor of Figure can be exposed for test patch development.
Figure 7:
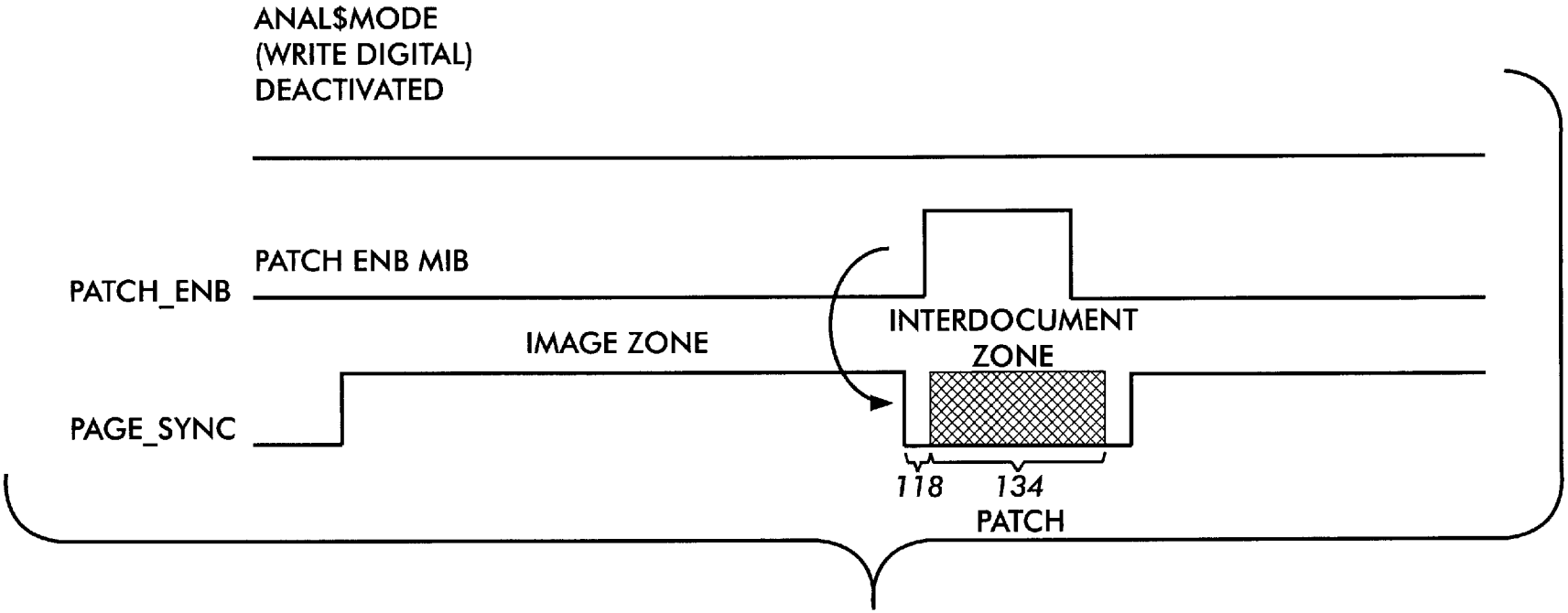
FIG. 7 is a timing diagram illustrating operation of a preferred test patch generation control approach.

Referring to FIG. 4, a description of the concept underlying the preferred embodiment is provided by way of a flow diagram—further comprehension of the significance of the flow diagram can be obtained by conjunctive reference to FIG. 7. Initially, a signal indicating that the writing of an image has been completed is provided at step 110. As will appear, the end of the image zone can be achieved by detecting a falling edge of a page sync (synchonization) signal. Referring to the query 112, if a signal calling for patch generation is received at an appropriate time (e.g. just prior to or just after the falling edge of the page sync), then the process proceeds to step 114; otherwise, a Return is effected at step 116.

Assuming a patch is to be generated, either a margin 118 (FIG. 7) is created through use of a suitable timing device (e.g. a digital counter) or the system waits until a suitable margin sync signal is received. Through employment of step 114, the system waits until a suitable instant in time for providing a write control signal. In the meantime, the ROS can be set in a suitable writing mode with step 120. In one example, the ROS can be set to write either black patches, or otherwise halftone patches (in an "analytical" mode). It should be appreciated that the ROS setting step 120 can be performed prior to either step 112 or 114. At the suitable moment, the PWP 107 (FIG. 3) produces and delivers as output a patch generation control signal, and as a result, a suitable timing device, e.g. any suitable logically based counting component, begins to count "line sync" signals (step 122), with each line sync signal corresponding to the period of time required for a sweep of the ROS writing beams across the photoreceptor in the fast scan direction. This period of time also establishes the separation of succeeding ROS writing beams in the slow-scan (process motion) direction. [During the active timing interval for patch generation of the timing device, defining slow-scan patch size, and further, during similar timing, positioning and sizing arrangement in the fast scan direction, the desired path is written by appropriately modulating the ROS exposure on the photoreceptor]. After the ROS has undergone a given number of line syncs (referred to as "Count" in step 124 of FIG. 4), test patch generation is ended and control of the PWP is relinquished. It will be appreciated, in view of the description below, that the Count is provided to the system in advance and accommodates for such variables as photoreceptor speed. Through use of such count, as will appear, the patch generation control system of the preferred embodiment can be programmed for use with photoreceptors of varying speeds.

Figure 5:
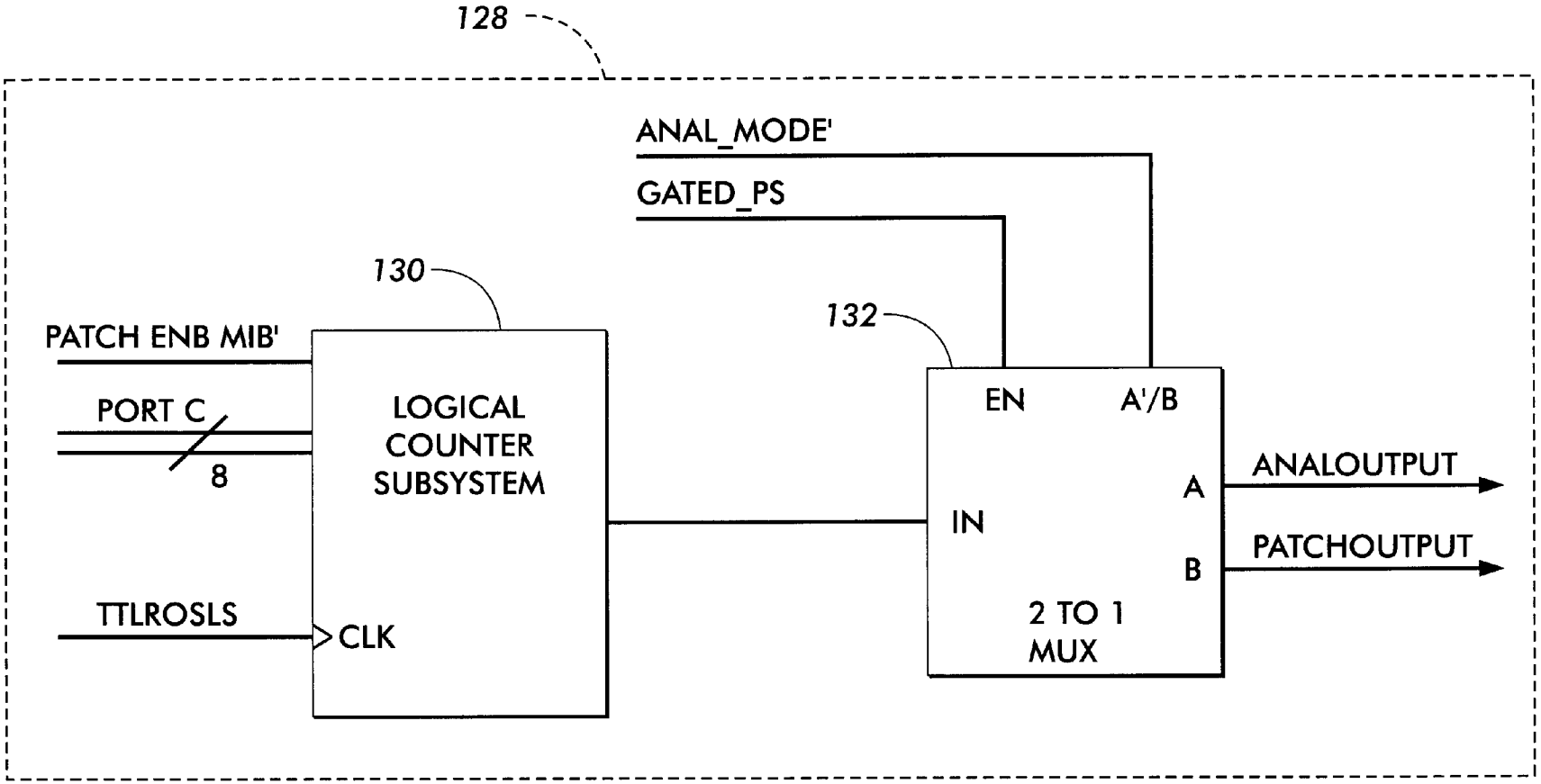
FIG. 5 is a block diagram of a first logical circuit suitable for use in implementing the test patch generation control system.
Figure 6:
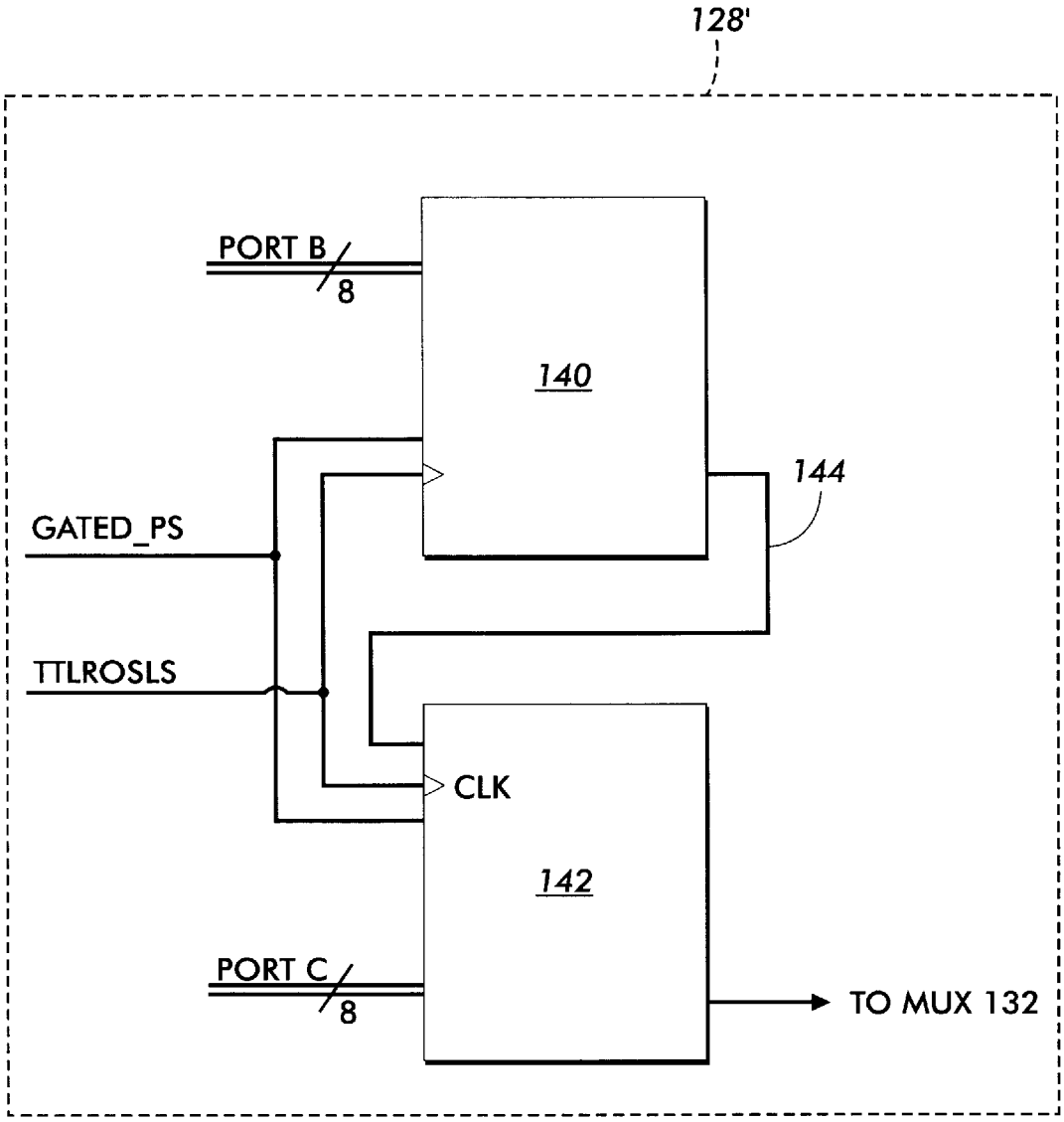
FIG. 6 is a block diagram of a second logical circuit suitable for use in implementing the test patch generation control system.

Referring now to FIGS. 5 and 6, exemplary logical circuitry appropriate for generating patch control signals is described. It should be recognized, particularly in view of the description of FIG. 4, that the patch generation control system could be implemented readily on a processor programmed with appropriate software. Referring specifically to FIG. 5, a first logical system for generating patch control signals is designated with the numeral 128. The system 128 includes a Logical Counter Subsystem 130 communicating with a multiplexor (MUX) 132. In view of the functional description below, the logical components required to implement the Logical Counter Subsystem and the MUX will be apparent to those skilled in the art.

The Logical Counter Subsystem 130 includes the following inputs:

- a signal from the MIB ("PATCH ENB MIB") indicating that a patch is to be generated and controlling when patch generation is to be initiated;
- a count provided from Port C within the SLB/RDR (FIG. 3), the count corresponding with the number of line syncs during which a patch generation control signal is to be enabled; and a clock signal ("TTLROSLS") associated with the ROS LS signal (FIG. 1.) for controlling the number of line syncs LS counted by a counter of the Logical Counter Subsystem.

The MUX 132 includes the following inputs:

an output from the Logical Counter Subsystem 130 indicating the interval in which the ROS is permitted to expose the photoreceptor for generating the test patch;

a page sync signal ("GATED PS") for indicating when the test patch can be written—when GATED PS is enabled, the test patch cannot be generated notwithstanding the state of the Logical Counter Subsystem; and a signal ("ANAL MODE") for setting the ROS into a black or gray patch writing mode, where "A" defines a gray patch modulated output signal pattern (to obtain signal analysis) and "B" defines a black signal pattern to assess toner density.

Referring conjunctively to FIGS. 5 and 7, operation of the first logical system 128 is described. Initially, the counter of the Logical Counter Subsystem is clocked with line syncs and is loaded with a value, namely a multi-bit word, which varies as a function of photoreceptor speed. The value, which is provided from one of the ports of the SLB/RDR (FIG. 3) apprises the counter of how many line syncs it should count out for defining the interval during which the photoreceptor is to be exposed for test patch generation. Finally, the rising edge of the PATCH ENB MIB signal (FIG. 7) starts the counter and enables the output of the Logical Counter Subsystem 130.

Referring still to FIGS. 5 and 7, assuming both the Logical Counter Subsystem output and the GATED PS are enabled, then one of ROS exposure signals ANAL OUTPUT and PATCHOUTPUT is enabled, depending on the setting of the ANAL MODE line. The duration of ANALOUTPUT or PATCHOUTPUT, each of which vary as a function of the value loaded into the counter, control the interval 134 (FIG. 7).

It should be appreciated that the object of the preferred embodiment is not directed toward the manner in which the ROS is modulated for the sake of exposing the test patch area, but rather toward a control technique which limits the duration in which the ROS can expose a portion of photoreceptor, e.g. an interdocument zone. More particularly, the ROS is permitted to expose the photoreceptor within the interdocument zone, in a preprogrammed fashion, when either ANALOUTPUT or PATCHOUTPUT is enabled. As contemplated, the exposure program might employ a system similar to that disclosed by U.S. Pat. No. 4,949,105, the disclosure of which is incorporated herein by reference, for actually exposing a selected test patch area. It should be recognized that the preferred control system serves as a control on the exposure program, so that exposure in the interdocument zone is constrained to a selected interval defined with the preferred control system.

Figure 8:
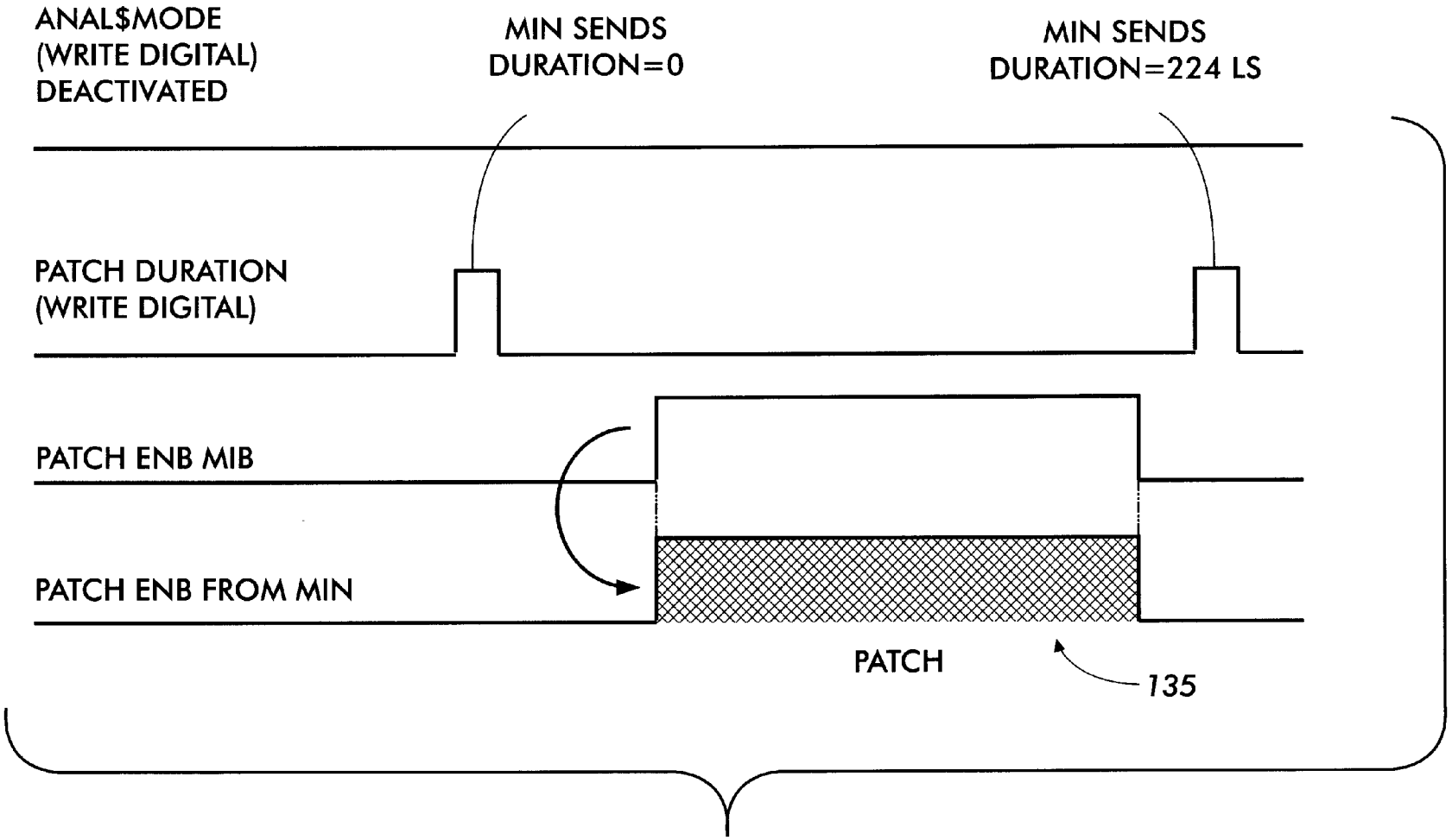
FIG. 8 is a timing diagram illustrating operation of an alternative test patch generation control approach.

Referring to FIG. 8, backwards compatibility with a pre-existing printing system can be maintained by interpreting a patch duration of 00 as a deactivation of the system 128 (FIG. 5), allowing a base printer generated patch signal to pass through unprocessed by the system 128. As shown in FIG. 8, the unprocessed signal 135 is initiated by, or corresponds with PATCH ENB MIB. To achieve backwards compatibility, it has been found that a decoder is preferably used with the Logical Counter Subsystem 130 for permitting the patch to pass through unaltered.

Referring back to FIG. 7, it has been found that the "margin" 118 need not be controlled by the rise or fall of PATCH ENB MIB. Rather, the margin can be generated through use of another counter in the logical system 128. More particularly, in a second logical system 128' (FIG. 6), the Logical Counter Subsystem 130 of FIG. 5 is modified with counters 140, 142, which counters would be coupled together for use in defining margin 118 (FIG. 7) and interval 134 respectively. That is, both counters would employ the GATED PS signal for the sake of loading the counters with multi-bit words or values obtained from the SLB/RDR.

Referring to both FIGS. 6 and 7, the counter 140 is loaded with an 8 bit word for counting the margin 118 and the counter 142 is loaded with another 8 bit word for counting the interval 134. Additionally, each counter counts in terms of line syncs since each of their respective clocks have the TTLROSLS input. In operation, the transition of GATED PS indicates when the counter 128 is to start counting, and once the counter 140 has counted enough line syncs to define margin 118, the output 144 enables counter 142 to count the interval 134. It should be recognized that the counters 140, 142 define the intervals 118, 134 whether a patch is to be written during the interval 134 or not. In use of the second logical system 128', it is assumed that a PATCH ENB MIB is communicated to the system 128' prior to the beginning of interval 134 so that it is known whether a signal, such as ANALOUT or PATCHOUT, is required to control the exposure of a test patch by the ROS.

In view of the description above, numerous features of the preferred embodiment will be appreciated by those skilled in the art:

First, the test patch generation control system of the preferred embodiment controls an extent to which the photoreceptor can be exposed for test patch development in a programmable manner. In this way, the duration of exposure, with respect to the process direction of the photoreceptor, can be adjusted readily when the speed of the photoreceptor is varied.

Second, the test patch generation control system can be retrofitted with preexisting systems in a convenient manner. This is because the system, in one mode of operation, can use a preexisting patch enable signal to start the duration of exposure.

Third, the duration of exposure can be controlled in an extremely accurate manner. That is, the duration is defined on the basis of a line sync count, which count permits highly precise test patch placement, resolved to the dimension of the ROS writing beam, or "pixel" size.

Finally, the risk of unintentionally overwriting a page image with a test page image is eliminated by the test patch generation control system. More particularly, in specified normal operation, the test patch generation control system does not permit the photoreceptor to be exposed, for the purpose of developing a test patch unless the page sync signal is in a selected state, defined as true for the interdocument zone

What is claimed is:

1. In a printing machine having a movable imaging member, a projecting system for modulating a beam and projecting an image into the movable imaging member, a developer for application of developer material to the image projected onto the movable imaging member for transfer of the image to a print medium sheet, a method for controlling exposure of a test patch on the movable imaging member comprising:

a) providing a time-keeping device with the time-keeping device including a variable value which is either incrementable or decrementable;

b) detecting a signal indicating that the movable imaging member is positioned relative to the writing exposure beam in a selected orientation, wherein the movable imaging member passes by the beam at a selected speed;

c) providing a reference value;

d) in response to said detecting of (b), modulating the beam, relative to the movable imaging member, so as to expose a portion for the test patch;

e) concurrent with said modulating of (d), incrementing or decrementing the variable value of the time keeping device; and f) repeating said modulating of (d) until the value of the variable value is about equal to the reference value and the test patch is exposed.

2. The method of claim 1, further comprising adjusting the value of the reference value when the selected speed of the movable imaging member changes.

3. The method of claim 1, wherein step (a) comprises providing a counter, wherein said (f) comprises repeating said modulating of (d) until the count of the counter is a selected one of greater than or less than the count of the counter.

4. The method of claim 3, in which the counter includes a clock driven by a line sync signal, further comprising configuring the counter so that the count varies as a function of the line sync signal.

5. The method of claim 1, in which the movable imaging member includes two spaced apart document zones, wherein said (b) includes using the signal to determine when the beam is disposed between the two spaced apart document zones.

6. The method of claim 5, in which a second signal is enabled each time the beam is disposed over one of the two spaced apart document zones, further comprising prohibiting performance of said (d) when the second signal is enabled.

7. The method of claim 5, further comprising delaying a selected time interval after said detecting of (b) and prohibiting performance of said (d) until said selected time interval has elapsed.

8. The method of claim 1, further comprising modulating the beam in a selected one of two modes, wherein a first type of patch is formed in a first one of the two modes and a second type of patch is formed in a second one of the two modes.

9. The method of claim 1, wherein said modulating includes scanning.

10. In a printing machine having a movable imaging member, a projecting system for modulating a beam and projecting an image into the movable imaging member, a developer for application of developer material to the image projected onto the movable imaging member for transfer of the image to a print media sheet, a method for controlling exposure of a test patch on the movable imaging member comprising:

a) providing a first time-keeping device and a second time-keeping device with each time-keeping device including a variable value which is either incrementable or decrementable;

b) detecting a signal indicating that the movable imaging member is positioned relative to the beam in a selected orientation;

c) in response to detecting the signal, using the first time-keeping device to wait a selected interval;

d) providing a reference value;

e) after waiting the selected interval of said (c), modulating the beam, relative to the movable imaging member, so as to expose a portion for the test patch;

f) concurrent with said modulating of (e), incrementing or decrementing the variable value of the second time-keeping device; and g) repeating said modulating scanning of (e) until the value of the variable value of the second time-keeping device is equal to the reference value and the test patch is exposed.

11. The method of claim 10, in which the movable imaging member passes by the beam at a selected speed, further comprising configuring the reference value to vary as a function of the selected speed.

12. The method of claim 10, in which the movable imaging member includes two spaced apart document zones, wherein said (b) includes using the signal to determine when the beam is disposed at the end of a first one of the two spaced apart document zones.

13. The method of claim 12, further comprising prohibiting the performance of said (e) when the beam is disposed over one of the two space apart document zones.

14. The method of claim 10, in which each of the first and second time-keeping device comprises a counter, further comprising providing each counter with a clock having a line sync signal so that each counter counts as a function of the line sync signal.

* * * * *